United States Patent [19]

Ohno et al.

[11] Patent Number: 5,033,208

[45] Date of Patent: Jul. 23, 1991

[54] HOPPER DRYER

[75] Inventors: Tsutomu Ohno; Motoharu Shimizu; Hikoichi Katsumura, all of Osaka, Japan

[73] Assignee: Kabushiki Kaisha Matsui Seisakusho, Osaka, Japan

[21] Appl. No.: 449,770

[22] Filed: Dec. 13, 1989

[51] Int. Cl.[5] ..... F26B 17/12

[52] U.S. Cl. ..... 34/168; 34/174; 34/175

[58] Field of Search ..... 34/165, 168, 174, 175

[56] References Cited

U.S. PATENT DOCUMENTS

| | | | |
|---|---|---|---|
| 3,848,344 | 11/1974 | Kemmetmueller | 34/168 |
| 4,004,351 | 1/1977 | Sanneman et al. | 34/174 |
| 4,120,644 | 10/1978 | Numasaki et al. | 34/168 |
| 4,289,481 | 9/1981 | Yano | 34/174 |
| 4,337,584 | 7/1982 | Johnson | 34/174 |
| 4,531,308 | 7/1985 | Neilson et al. | 34/174 |
| 4,914,834 | 4/1990 | Sime | 34/174 |

*Primary Examiner*—Henry A. Bennett
*Assistant Examiner*—Denise L. Gromada
*Attorney, Agent, or Firm*—Jones, Tullar & Cooper

[57] ABSTRACT

A hopper dryer for drying pelletized or granular resin material comprising a heat source at its center and double concentric cylinders which comprises an inner and an outer cylinder with many apertures to permit passing of heated gas respectively so as to form a doughnut-like material storing space therebetween. The gas is fed into the heat source to be heated, then passes through the apertures of the inner cylinder and discharged through the apertures of the outer cylinder so that the pelletized or granular resin material stored in the doughnut-like space formed between the inner and outer cylinder are preheated and dried.

2 Claims, 4 Drawing Sheets

HOPPER DRYER

BACKGROUND OF INVENTION

I. Field of the Invention

This invention relates to an improved hopper dryer for use in preheating and drying pelletized or granular resin.

II. Prior Art

In a conventional method for drying resin materials, such as pelletized resin, the pelletized resin materials are preheated to promote of softening and dissolving, and simultaneously heated air is blown into a hopper for drying in which pelletized resin materials are stored before the resin materials are fed into a molding machine.

However, according to such a conventional method, a large hopper tank is needed and the space required apt to be large. As a result, the sizes of the drying equipment becomes large as a whole, since the hopper is designed such that heated air is blown therein to dry the materials with the hopper filled with resin materials.

Further, since the conventional hopper is designed such that heated air is blown therein for drying from the underside thereof with the hopper filled with resin materials, it takes a long time to dry the resin materials, and what is worse a uniform drying condition can not be expected. In addition to the above mentioned drawbacks, dispersion in drying would arise depending on the up and down position in the hopper dryer in which resin materials are stored.

A hopper dryer comprising double concentric cylinders has been proposed to solve the above mentioned problems.

FIG. 4 illustrates the conventional type of hopper dryer having double cylinders. The main body 100 of the hopper dryer is constructed such that an inner wall 102 having a plurality of apertures 102*a* for the suction of heated air is disposed concentrically in an outer wall 101 having a plurality of apertures 101*a* for the suction of heated air. At the top portion of the inner wall 102 an air suction source such as a vacuum pump (not shown) is connected and a heater band 103 is provided around the external circumference of the outer wall 101. Resin materials 106 are stored in a hopper 105, disposed at the upper portion of the hopper dryer, and are fed into the space between the outer wall 101 and the inner wall 102 of the main body 100 and dried by the air heated by the heater band 103.

However, since the heater band 103 is provided at the periphery of the outer wall 101 in the above mentioned dryer, the space between the outer wall 101 and the inner wall 102 which forms a storage space for pelletized resin would be reduced if the equipment, as a whole is reduced in size.

Furthermore according to such a hopper dryer, it has disassembly and cleaning of the hopper presents troubles, especially when resin materials to be stored are exchanged frequently, since the dryer is constructed such that the heater band 103 is disposed outside of the outer wall 101.

SUMMARY OF THE INVENTION

Accordingly, the present invention has been developed to solve the above mentioned problems and has an object to provide a hopper dryer which has a compact body and can dry pelletized or granular resin uniformly in a short time.

To achieve this object the hopper dryer of the present invention is constructed such that a heat source is provided at the center of the main body, an inner cylinder with many apertures to permit passing of heated gas is vertically disposed at the periphery of the heat source, an outer cylinder with a plurality of apertures to permit discharging of the heated air is disposed concentrically around the inner cylinder and a doughnut-like space between the cylinders is formed to be a material storing space. In the hopper dryer, a drying gas is supplied into the inside of the inner cylinder and is heated by the heat source. Thus the material storing space is heated by the drying gas when the gas is discharged into the apertures of a outer cylinder through the apertures of the inner cylinder. As the result, the transportation area of the gas becomes large, the air resistance is reduced, and the flow of heated gas increases. Furthermore, the temperature of the resin materials rises quickly, the drying time becomes remarkably short, and the nonuniformity of drying conditions is reduced.

BRIEF DESCRIPTION OF THE DRAWINGS

A description will now be given of a preferred embodiment of the invention with reference to the accompanying drawings wherein.

DETAILED DESCRIPTION OF A PREFERRED EMBODIMENT

A preferred embodiment of the present invention will discussed in detail with reference to the drawings.

Figure 1:
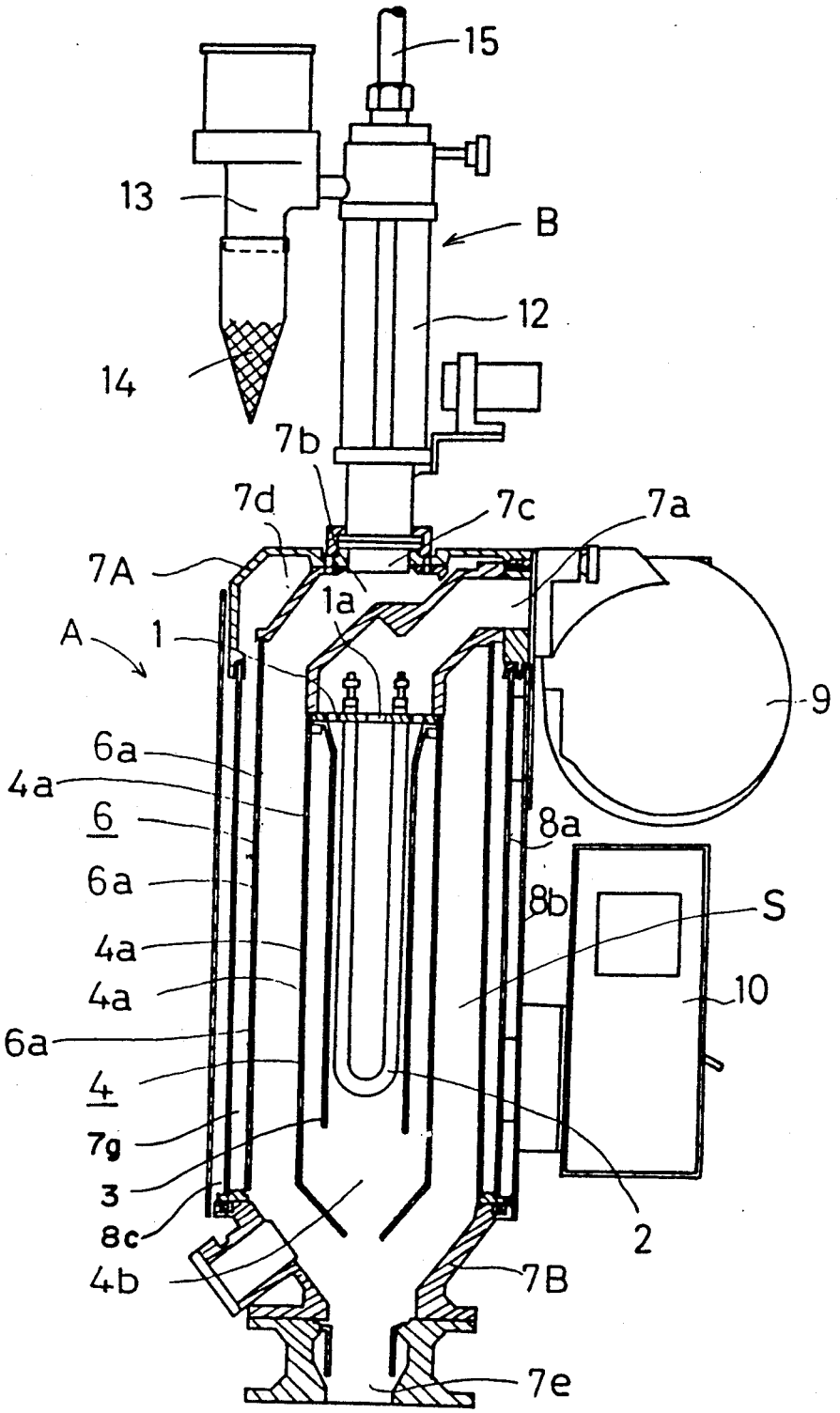
FIG. 1 illustrates a vertical section view indicating the hopper dryer according to the present invention.
Figure 2:
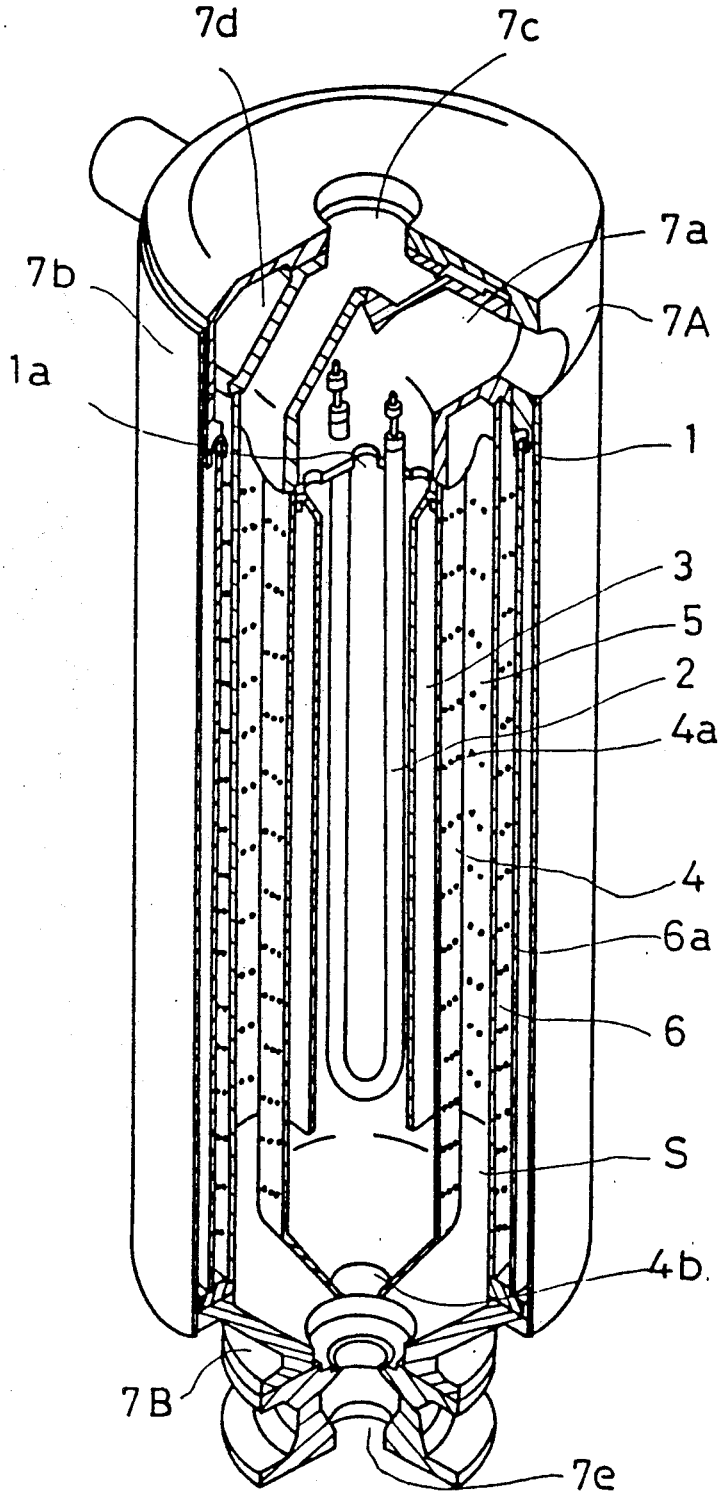
FIG. 2 shows a partial cutaway view in perspective of the main body of the hopper.

As illustrated in FIG. 1 and FIG. 2, the hopper dryer is constructed such that a cylindrical main body casing A has double external walls 8*a* and 8*b* for heat insulation, which together define a heat insulating space 8*c*, a support plate 1 at its upper center 1 having vents 1*a* disposed therein from which three heat sources 2 are hung, and a cylindrical heat conduit pipe 3 disposed with a proper space so as to surround the heaters 2.

At the periphery of the heat conduit pipe 3, an inner cylinder 4 having a plurality of apertures 4*a* to permit passing of heated gas and a tapered opening end 4*b* is provided, an outer cylinder 6 having a plurality of apertures 6*a* to permit discharging of the heated gas is disposed concentrically at the periphery of the inner cylinder 4.

An upper casing 7A of the hopper body is provided with an air passage 7*a* which extends to the heat conduit pipe 3 from a blower 9 disposed at the outside of the body, a material supply passage 7*b* which extends upwardly from the space between the inner cylinder 4 and an outer cylinder 6, and a discharge passage 7*g* which extends upwardly between the outer cylinder 6 and the internal wall 8*a* of double walls 8.

The support plate 1, the inner cylinder 4 and the outer cylinder 6 are mounted to the upper casing 7A of the main body A. The support plate 1 is fixed to the opening portion of the air passage 7*a* connected to the blower 9, the inner cylinder 4 extending downwardly under the air passage 7*a*, the opening end of which is closed by the plate 1, and the outer cylinder 6 is connected to supply passage 7*b* and extends downwardly therefrom.

The main body A of the hopper constructed as mentioned above has a tapered lower end portion formed by a lower casing 7B provided with a material discharge opening 7*e*, the opening 7*e* being connected to the material supply port of a plastic molding machine (not shown).

In the figures, the numeral 10 indicates a control box attached to the peripheral wall of the main body A of the hopper.

Figure 3:
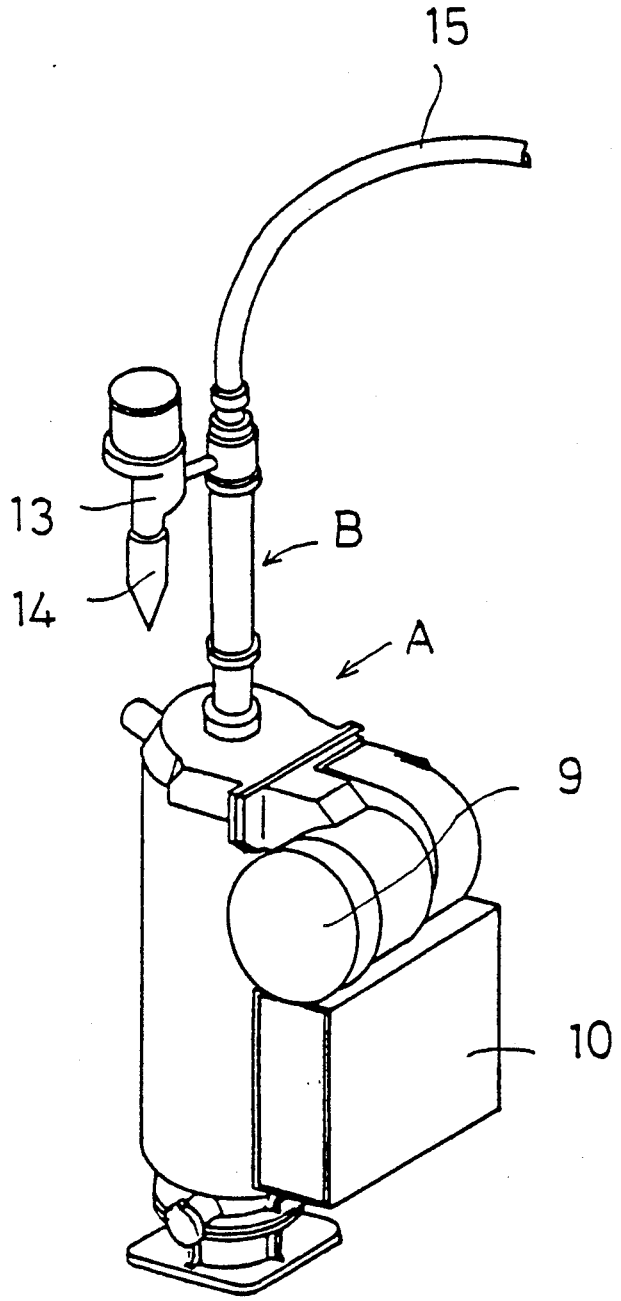
FIG. 3 is an external perspective view of the hopper dryer.
Figure 4:
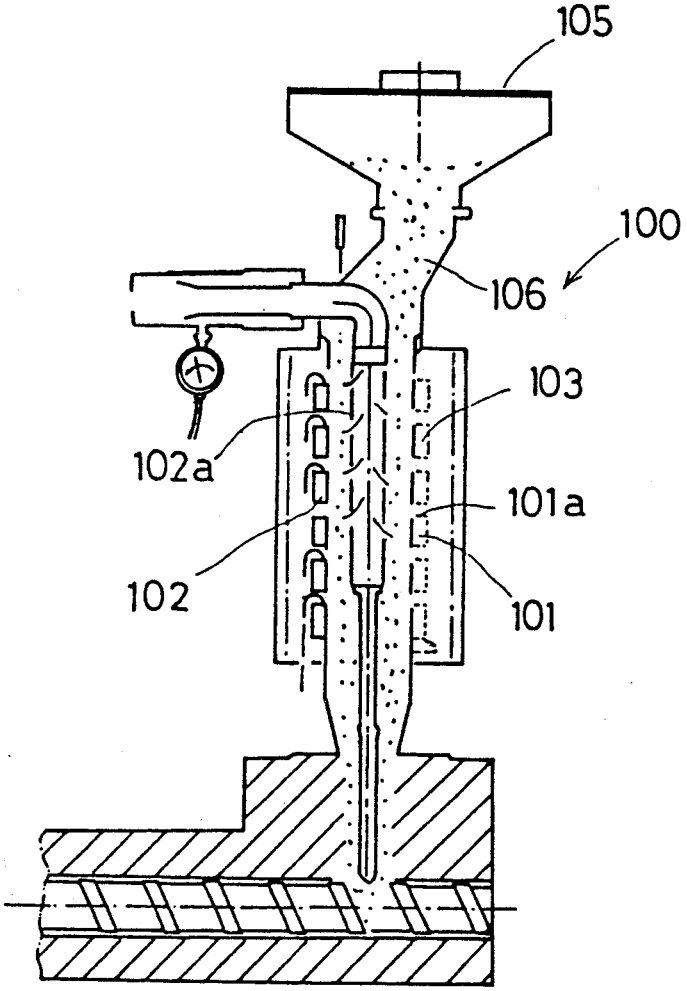
Fig. 4 PRIOR ART
FIG. 4 illustrates the construction of a conventional hopper dryer having double cylinders.

As shown in FIG. 3, the hopper dryer according to the present invention characterized by the above mentioned parts is designed to be attached by a collector B to a material supply port 7*c* provided at the upper portion of hopper body A. The collector B is designed to catch resin materials temporary before the resin materials are fed into the hopper body A and to keep the material in the hopper body A fully charged.

The collector B has an external wall 12 made of transparent material. The numeral 13 indicates a degassing portion to discharge transport gas such as air to be fed into the collector B together with resin materials. And under the degassing portion 13 is a filter 14 provided to separate air from dust mixed in the materials. Collector B is connected to a material supply pipe 15 at its upper portion.

According to the hopper dryer as mentioned above, when resin materials are fed into the collector B through a material supply pipe 15 by a pneumatic transporter, the materials are discharged from the material supply port 7*c* of the hopper body A and fill in the space S which is formed between the inner cylinder 4 and the outer cylinder 6 and has a doughnut like cross section.

On the other hand, the gas supplied into the heat conduit pipe 3 through the air passage 7*a* from the blower 9 is heated by means of the heat sources 2 and becomes heated air. Then the heated air is supplied into the spaces in which resin materials are stored through the apertures 4*a* of the inner cylinder 4 and is discharged radially through the apertures 6*a* of the outer cylinder 6, to the atmosphere through the discharge port 7*d* or is returned to the blower 9.

According to the hopper dryer of the present invention, the resin materials are preheated and dried while heated gas passes through the spaces. In this case, the gas passes radially from the center to the exterior layer of resin which forms a doughnut-like layer. Therefore, compared with the conventional hopper dryer constructed such that the heated air passes from the bottom to the upper layer of resin, the air resistance may be reduced and the heated gas may pass more easily. As a result, the temperature of the resin materials can rise more quickly and the drying time can be remarkably short.

According to the constructional features of the hopper dryer of the present invention the, following effects can be preferably expected.

As the material storing space is formed like a doughnut and the heated gas for drying is discharged radially from the center into the exterior layer of resin, the transportation area of the gas becomes larger, the air resistance is reduced and the flow of heated gas increases. Therefore, the drying time can be reduced remarkably.

The hopper dryer of the present invention of a double cylindrical body type which has a heat source at its center is constructed such that both the inner cylinder and the outer cylinder can be removed when the upper part is detached. Therefore, the dryer is easy to disassemble and the body cleaned. This capability is useful especially when the resin materials are frequently exchanged.

As the hopper dryer of the present invention is constructed so as to be concentric with the heat source disposed at the center of body, a substantially larger storing space for resin materials can be attained as opposed to the conventional type of dryer in which the heat source is disposed peripherally.

What is claimed is:

1. A hopper dryer, comprising a main body casing having:

an outer cylindrical body;

double walls spaced externally of said outer cylindrical body, said double walls comprising an inner wall and an outer wall which form an insulation air layer between them;

an inner cylindrical body;

heating means situated within said inner cylindrical body;

an upper casing, said inner cylindrical body and said heating means mounted to said upper casing; and mounting means for removably mounting said outer cylindrical body and said double walls to said upper casing, wherein:

said outer cylindrical body has a plurality of apertures to permit passage of heated gas therethrough, and said inner cylindrical body has a plurality of apertures to permit passage of heated air therethrough;

said upper casing defining an air passage communicating with the outlet of a blower which supplies air to the main body;

said outer cylindrical body being disposed inside of said inner wall and forming a doughnut-like air discharge passage therewith; and said outer cylindrical body and said inner cylindrical body forming a doughnut-like passage serving as a resin storing space.

2. The hopper dryer as defined in claim 1, wherein:

said upper casing further defines a discharge passage which communicates with said doughnut-like air discharge passage formed by said inner wall and said outer cylindrical body; and air passes from said air passage into communication with said heating means, through both said doughnut-like passages to said discharge passage and back to the blower for delivery to said air passage.

* * * * *